United States Patent [19]

Murphy

[11] 4,049,076

[45] Sept. 20, 1977

[54] SOUND DAMPING APPARATUS

[75] Inventor: Milo E. Murphy, Long Beach, Calif.

[73] Assignee: Murphy Muffler, Inc., Los Angeles, Calif.

[21] Appl. No.: 629,682

[22] Filed: Nov. 6, 1975

Related U.S. Application Data

[62] Division of Ser. No. 408,388, Oct. 23, 1973, Pat. No. 3,918,549.

[51] Int. Cl.[2] ..... F01N 1/08

[52] U.S. Cl. ..... 181/224

[58] Field of Search ..... 181/35 A, 36 A, 36 B, 181/40, 47 A, 61, 64 R, 64 A, 64 B, 65, 53–55

[56] References Cited

U.S. PATENT DOCUMENTS

| | | | |
|---|---|---|---|
| 3,590,945 | 7/1971 | Murphy | 181/40 |
| 3,688,869 | 9/1972 | Murphy | 181/40 |
| 3,754,620 | 8/1973 | Foster et al. | 181/53 |
| 3,779,340 | 12/1973 | Hoffman et al. | 181/49 |
| 3,884,655 | 5/1975 | Coop | 181/55 X |

*Primary Examiner*—Lawrence R. Franklin
*Attorney, Agent, or Firm*—Wm. Jacquet Gribble

[57] ABSTRACT

A sound damping apparatus has a resilient wall that defines a first volume and rigid walls defining a second or third volume. A gas entry communicates with the volume defined by the resilient wall. The resilient wall and the rigid walls are in contact such that gas pressure separates the walls and the wall to intermittently define a gas exit between volumes within the wall.

1 Claim, 14 Drawing Figures

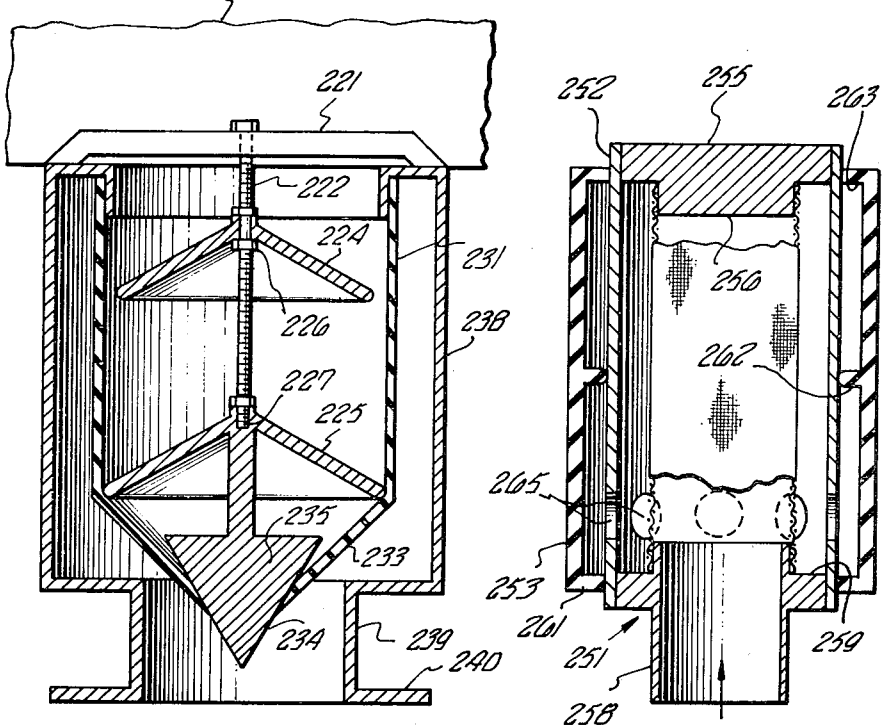
FIG. 13
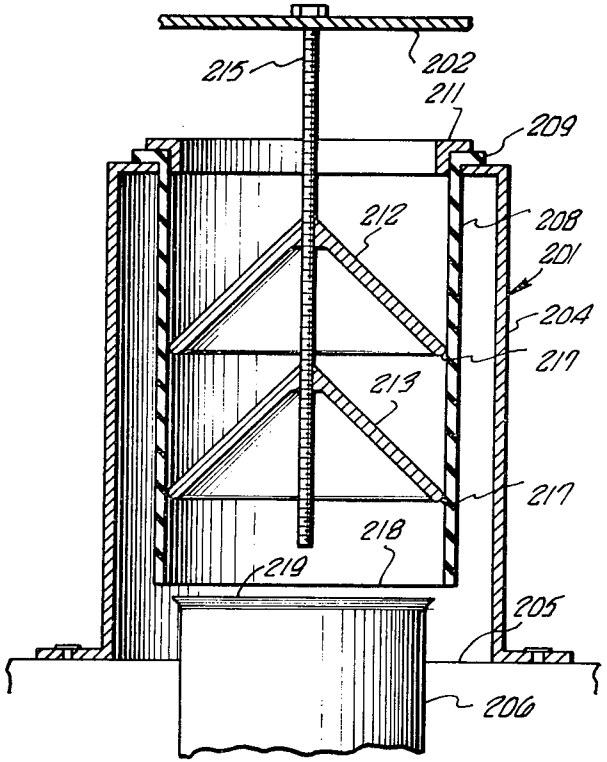
FIG. 12
FIG. 14

SOUND DAMPING APPARATUS

RELATED APPLICATIONS

This application is a division of my copending application Ser. No. 408,388 filed Oct. 23, 1973, now U.S. Pat. No. 3,918,549.

BACKGROUND OF THE INVENTION

The invention relates to sound dampeners or mufflers and is applicable both to gas intake and gas outlet devices. Prior U.S. Letters Patent issued to applicant in related fields are U.S. Pat. Nos. 3,482,649 entitled "Exhaust Muffler For Combustion Engines" issued Dec. 9, 1969 and 3,688,869 entitled "Muffler With Resilient Exterior" issued Sept. 5, 1972. Other prior art in this field is exemplified by U.S. Letters Patent to H. S. Hoffar: U.S. Pat. Nos. 2,859,830 titled "Vibratory Flexible Silencers" issued Nov. 11, 1958 and 2,877,860 entitled "Apertured Pliable Resilient Damper Wall Silencer" issued Mar. 17, 1959.

With respect to exhaust gases which are the result of combustion, a major problem has been develop a sound damper which does not deteriorate due to the temperature of the exhaust gases. Such is not the problem with most intake devices where the greater problem is the wide range of frequency fluctuation induced by the fluctuating gas pressure. In both intake and exhaust applications the sound damping device must be operative over a great range of noise frequency. I have invented a sound damper for intake and exhaust gases which solves both heat and frequency problems in a unique combination of elements which may be embodied in a variety of devices each capable of a great range of utility.

SUMMARY OF THE INVENTION

The invention contemplates a gas sound damper adapted to both intake and exhaust gas situations which comprises a resilient wall defining a first volume and substantially rigid spacers dividing the volume into second and third volumes. Gas entry and exit means communicate with the volume so defined. Framing means supports the spacers in contact with the resilient wall. In a preferred form of the invention an additional volume is defined by rigid means encompassing the resilient wall, but connected thereto to induce flow between the subdivided volume within the resilient wall to supplement the effective damping frequency range of the resilient wall itself.

The sound damper of the invention adapts to a large variety of usage, and can be fabricated at low cost from presently known commercial materials. These and other advantages of the invention are apparent from the following detailed description and drawing.

BRIEF DESCRIPTION OF THE DRAWING

FIG. 5 is a partial transverse section of an alternate embodiment of a sound damper similar to the embodiment of FIG. 4;

FIG. 8 is a sectional elevation of a still further alternate embodiment of the invention suitable for use for combustion exhaust gases;

FIG. 12 is a fragmentary sectional elevation of an alternate embodiment of the invention combined with the intake manifold of a combustion engine;

FIG. 13 is a further alternate embodiment of the invention shown in fragmentary sectional elevation and adapted for use with a combustion engine air intake; and FIG. 14 is an alternate embodiment of the invention shown in sectional elevation.

DESCRIPTION OF THE PREFERRED EMBODIMENTS

Figure 1:
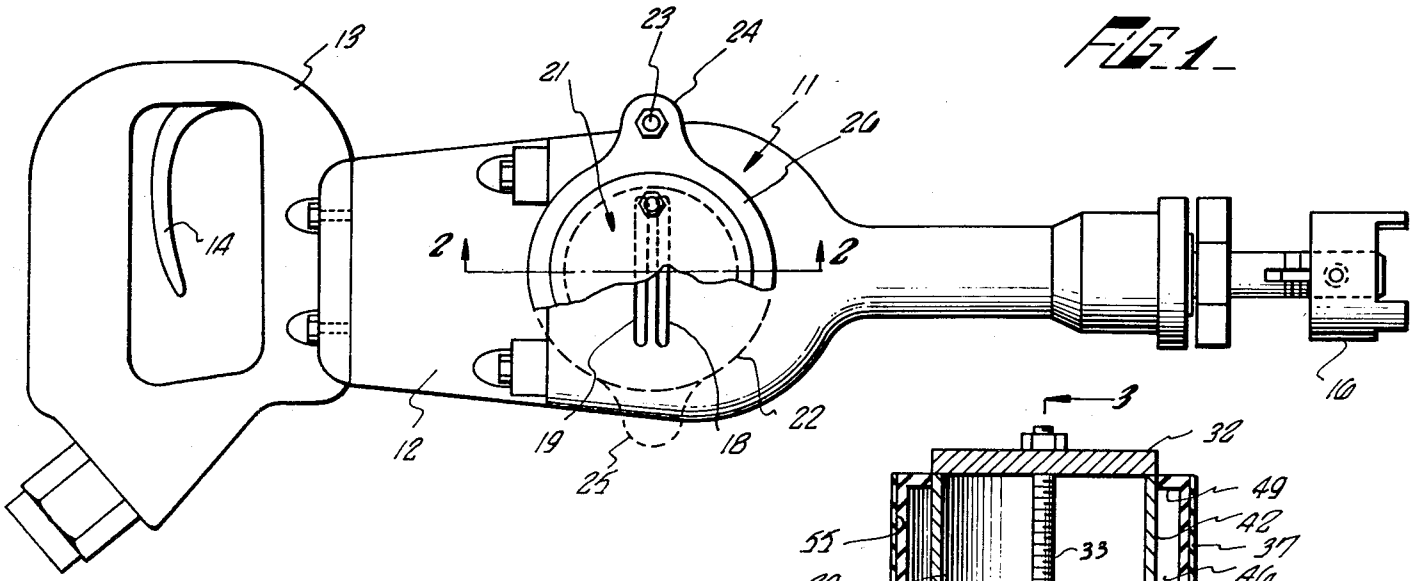
FIG. 1 is a side elevation of a pneumatic tool having a sound damper in accordance with the invention attached thereto.
Figure 4:
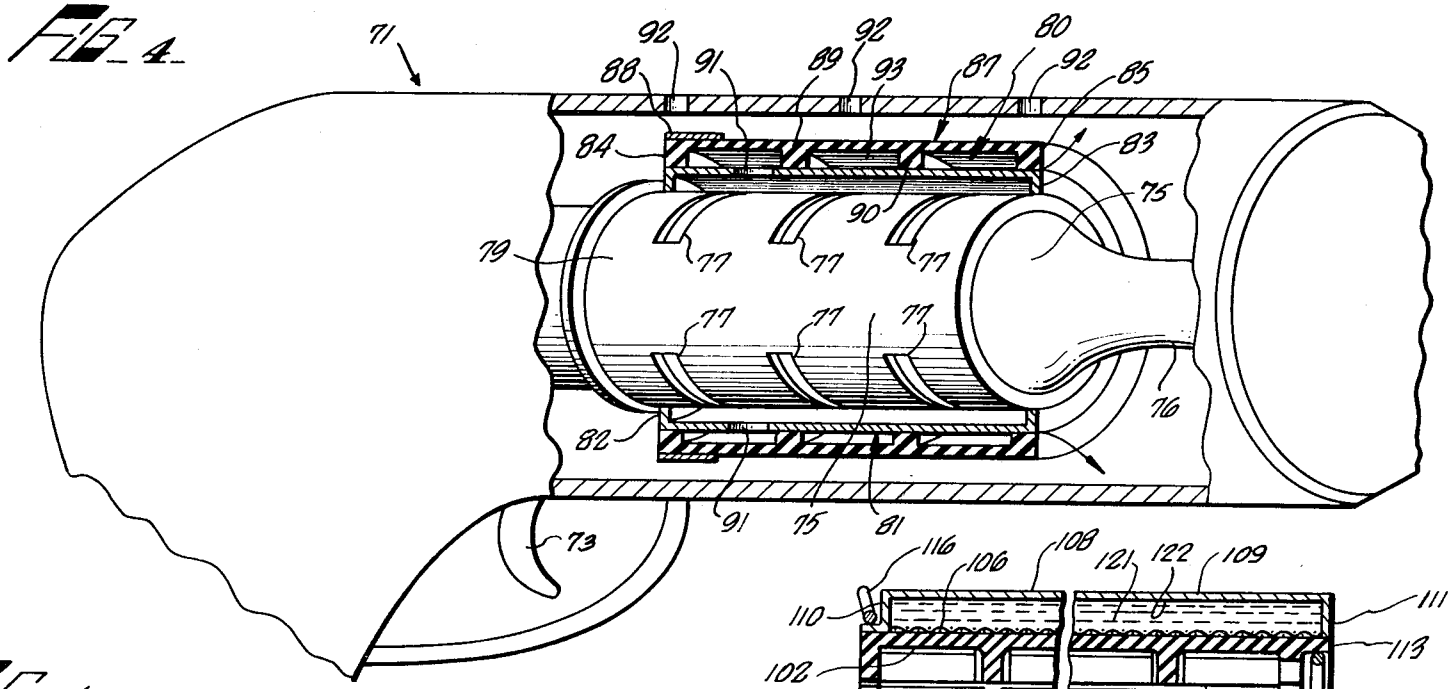
FIG. 4 is a fragmentary elevation, partly in section, of a further alternate embodiment including a pneumatic rotary tool.
Figure 6:
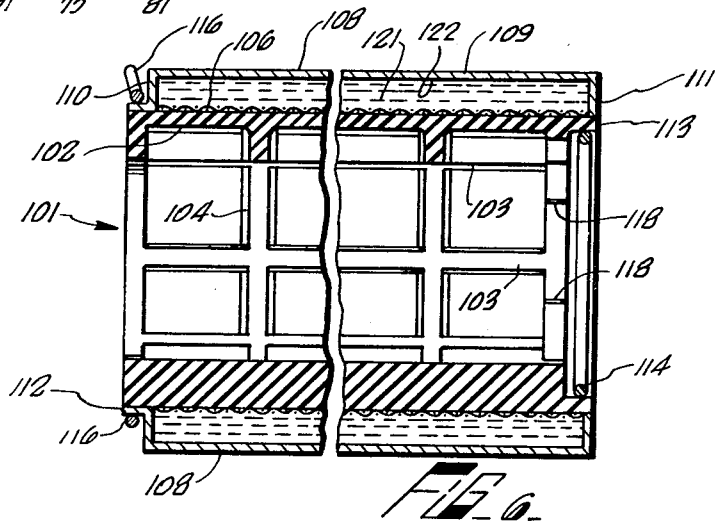

The embodiments of FIGS. 1 and 4 include pneumatic rotating or reciprocating devices wherein air or other gas under pressure is the motive force. In the embodiment of FIG. 1 the sound damping device is external of the pneumatic tool. In the embodiment of FIG. 4 the sound damping element is within the external casing of the tool. For instance, in FIG. 1, a pneumatic tool 11 has a conventional configuration including an outer casing 12, a control handle 13 with an actuating trigger 14 and an attachment coupling 15 for the air hose or other compressed gas supply. A tool holder 16 at the opposite end of the pneumatic tool provides means for attachment of whatever workpiece is desired.

Air exhausting from the operating turbine (not shown) of the pneumatic tool emerges from casing 12 through circumferential slots 18, 19 of FIG. 1. A sound damper 21 in accordance with the invention is shown fragmentarily, secured to the pneumatic tool 11, with the outline of the remaining portion of the damper shown in dotted lines 22. The sound damper 21 may be secured to the case by a tool girdling U-bolt 23 whose threaded ends are secured by nuts to the opposd ears 24, 25 of an attachment base 26 of the sound damper. The invention does not preclude use of other lock fasteners such as bayonet lugs, or threaded fasteners fixed to the casing 12 fitting into complementary apertures in the base. However, the illustrative U-bolt affords easy means of combining a sound damper of the invention with an unaltered conventional pneumatic tool.

Figure 2:
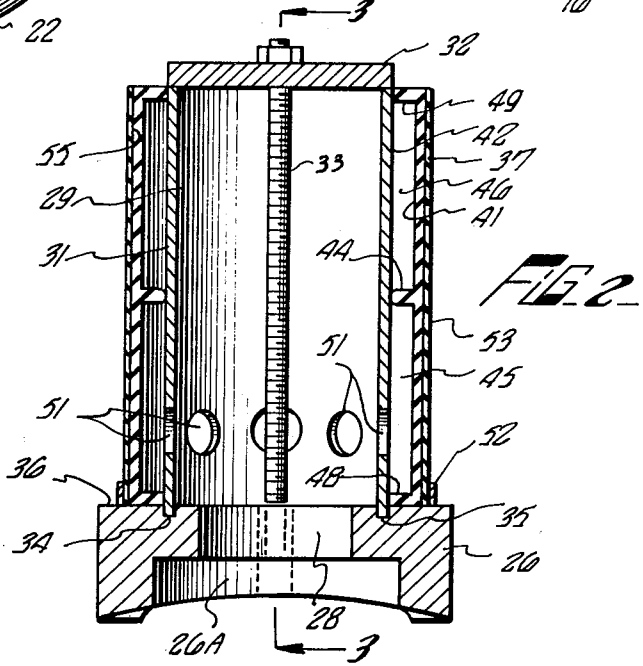
FIG. 2 is a sectional view of the sound damper taken along line 2—2 of FIG. 1.

The cross-sectional view of FIG. 2 shows the general construction of the sound damper of FIG. 1 with the base 26 having a semispherical or other curved bottom surface 26A adapted to fit in sealing relationship to the pneumatic tool casing 12 about the exhaust slots 18, 19. The base has a stepped exhaust gas intake 28 through which gas emerges into a first volume 29 defined by a cylindrical canister 31. An end plug 32 closes the volume 29 and is secured by a pair of elongate threaded rods such as the rod 33 of FIGS. 1 and 2 to the canister in sealing relationship as is the canister to the base 26. A bottom end 34 of the canister seats in an annular groove 35 formed in an upper surface 36 of the base.

A resilient cylindrical sheath 37 surrounds the canister 31. Preferably the sheath is of a silicone rubber. The inner surface 41 of the sheath is spaced from the outer surface 42 of the canister to define a volume which is divided by an inwardly projecting circular rib 44 into second and third volumes 45, 46. The sheath has annular sealing ends 48, 49 at each of its extremes which contact the inner canister to close the second and third volumes. A plurality of arcuately spaced apertures 51 communicate between the first volume 29 defined by the canister and the second and third volumes defined by the canister and the sheath.

A flexibly woven band 53 may be adhered or molded into the resilient sheath to strengthen the sheath against the gas pressures involved and also to afford an interface at 55 at the juncture of the sheath and the afford an interface at 55 at the juncture of the sheath and the band to effect further damping of low frequency sound from the fluctuating gas stream passing through the sound damper 21.

In operation the sound damper of FIG. 1 receives gases, such as compressed air, through the gas intake 28 from the exhaust ports 18, 19 of the pneumatic tool 12 of FIG. 1 and such gases circulate rapidly within the volume 29 of the canister 31. A portion of the gases emerges immediately into the second volume 45 via apertures 51 while other components of each gas pulsation reflect from end cap 32 and then pass through the apertures 51. As the gas pressure mounts within the second volume 45 defined within the resilient sheath between rib 44 and sealing end 48, the sheath is expanded centrally to remove rib 44 from sealing contact with canister 31, permitting gas to pass from second volume 45 into third volume 46. Similarly, increasing gas pressure within the third volume 46 expands the resilient sheath in the vicinity of sealing end 49 and the gas exhausts to atmosphere from the device between the interval created by expansion of the sealing end from the outer periphery of the canister, the opposite sealing end being nonmovable because of restricting band 52.

The exhausting gas loses energy as it works to expand the resilient sheath at each transfer between volumes. Some sound absorption occurs in the mass of the end cap and the mass of the canister. Heat is also absorbed and radiated through both the base 26 and the end cap 32. As described previously in U.S. Pat. No. 3,688,869, high and low frequency sounds tend to be damped by reflection and frequency shift from the interface (selectively in accordance with frequency) between the band and the resilient sheath.

Figure 3:
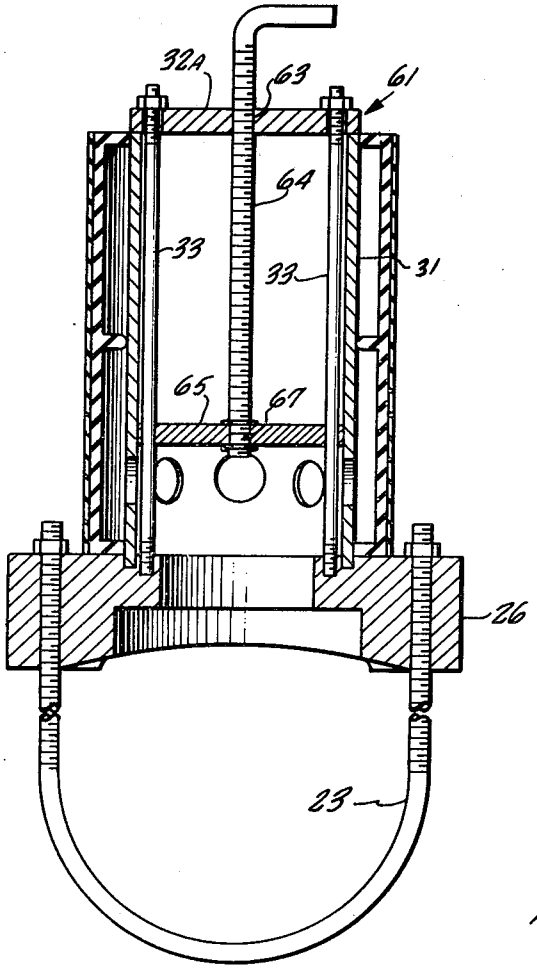
FIG. 3 is a sectional view showing an alternate embodiment of the invention.

FIG. 3 illustrates a further embodiment similar to that described with respect to FIG. 1. A sound damper 61 is similar in having a shaped base 26 and an attachment U-bolt 23 to secure the device to a pneumatic tool like tool 12 of FIG. 1. The canister 31 thereof is similarly secured to the base by threaded rods 33. A resilient sheath 37 with an exterior reinforcing band 53 is fitted to the canister to define second and third volumes: exteriorly of the canister. However, cap 32A of the device of FIG. 3 has a threaded central aperture 63 which is threadably engaged with a threaded member 64 adapted to advance and retract with respect to the end cap upon rotation of the member 64. A resonance tuning baffle 65 is fittted to the end of member 64 by means of C-rings 66 lodged in grooves in the member end 67. Rods 33 preclude rotation of the baffle, so it must be free with respect to the rotatable threaded member in order to effectuate reciprocation in the canister.

The device of FIG. 3, of course, must be assembled in a selected order to permit accomplishment of the assembly shown, the notched end 67 of threaded member 64 being passed through the aperture 63 and the baffle 65 secured to the threaded member by the C-rings prior to the assembly of the end cap and the threaded rods 33 with the base 26. The baffle is capable of adjustment within the first volume 29 to tune the resonance of the sound damper for optimum performance of the pneumatic tool with regard to the fluctuation of the exhaust gas column and the frequency of such fluctuations at the pressure of operation.

A pneumatic tool 71 shown in FIG. 4 has an outer casing 72 and an actuating trigger 73. Within the casing is a conventionally mounted suitable air turbine 75 from which a rotating work shaft 76 extends through the end of the casing to a work tool not shown. Expended air or gas emerges from the turbine through a plurality of arcuate slots 77. The slots penetrate a turbine stator 79 having a substantially cylindrical outer periphery. The stator is surrounded by a rigid canister 81 having annular end ribs 82, 83. The ribs 82, 83 seal the volume defined between the stator periphery and the rigid canister.

End ribs 84, 85 of a resilient sheath 87 extend radially inwardly from the sheath 87 in a sealing relationship with the metallic canister 81. A tension band 88 of conventional configuration secures the sheath at rib 84. Subdividing arcuate sheath ribs 89, 90 are intermediate the end ribs.

The enclosed sound damper 80 of FIG. 4 is similar to the previously described embodiment in that a metallic canister is surrounded by the resilient sheath. In each instance, the resilient sheath and the metallic canister cooperate to damp the sound frequencies in both high and low ranges due in part to the effect of the volume defined between them. Axial exhaust gases from the sound damper of FIG. 4 exhaust from the arcuate slots of the stator into the volume defined by the stator periphery, the cylindrical canister wall and its end ribs 82, 83. A plurality of circumferentially spaced canister ports 91 conduct the exhaust gases from the canister into the volume enclosed by the resilient sheath. Since the volume is sealed by anchored end rib 84, exhaust gases pass between the outer periphery of the metallic canister and the inward surface of intermediate sheath ribs 89, 90 and exit between the canister and end sheath rib 85 into the tool interior. The gases then pass to atmosphere through conventional case ports 92 of the pneumatic tool.

Figure 6:
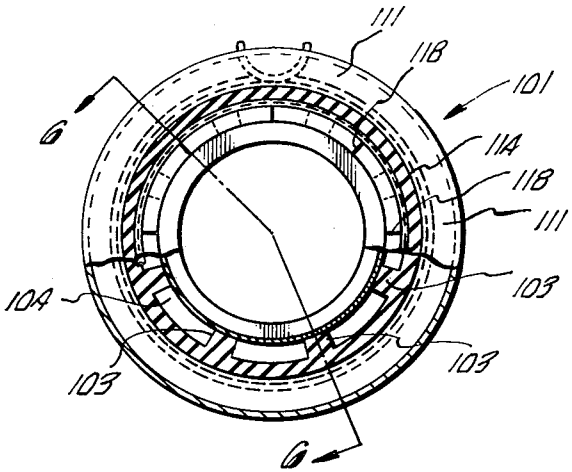
FIG. 6 is a sectional view of the alternate embodiment taken along line 6—6 of FIG. 5.
Figure 2:
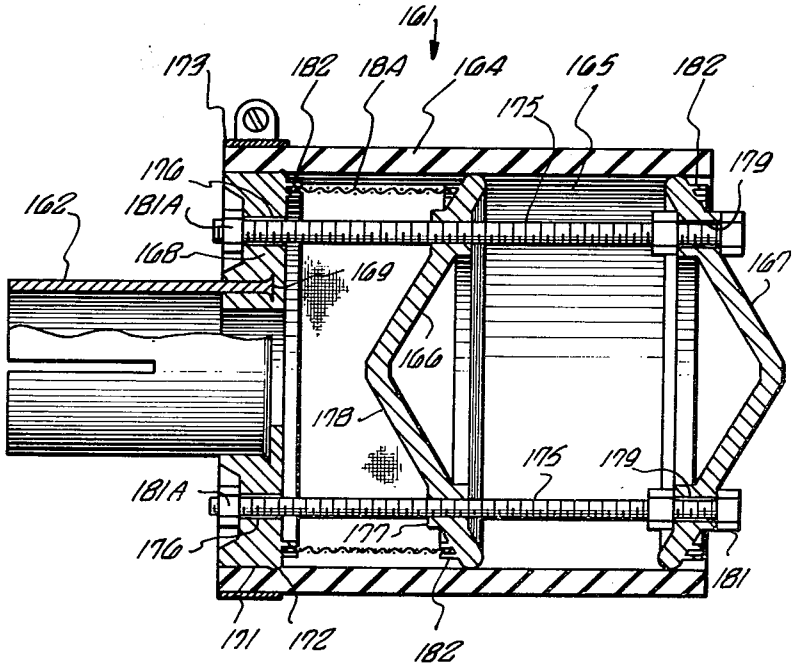

The sound damper 101 of FIGS. 5 and 6 differs from the previously described embodiments in that a resilient sheath 102 is surrounded by a rigid canister. The sound damper 101 is adapted to use about a stator such as the stator 79 shown with respect to the embodiment of FIG. 4. The sound damper has a resilient sheath 102 which is cylindrical in configuration and contains a plurality of inwardly projecting axial ribs 103 which bear against the stator as if it were an inner rigid canister. The peripheral volumes defined by the axial ribs may be further subdivided by inwardly projecting circumferential ribs 104, resulting in a grid pattern on the interior of the resilient sheath. Preferably the ribs and the sheath are integrally formed. The sheath may be outwardly strengthed by a woven fabric 106 in a manner previously described. The fabric is preferably oriented such that the strands thereof run at an angle to the axis of the sheath.

A metallic canister 108 surrounds the resilient sheath. The canister comprises an outer cylinder 109 and inwardly projecting end ribs 110, 111. Rib 111 has a lip 112. The resilient sheath has a protruding annulus 113 against which the end rib 111 bears. An expanding lock ring 114 imposes the sheath protuberance 113 against the canister to effect a seal. The opposite sheath and canister ribs are secured respectively to the sheath and the stator (not shown) by a wire lock ring 116 bearing on lip 112. As can be best seen from FIG. 5, a plurality of radial slots 118 in an end wall 119 of the resilient sheath provides a plurality of exit passages for the gases discharged from the stator into the resilient sheath volume.

The structure described defines an annular volume 121 between the sheath and the canister. This volume is effectively sealed by the lock rings 114 and 116. Preferably the volume is filled with a fluid, either gas or liquid, of relatively high heat conductivity. The liquid defines with the outer periphery of the sheath an interface 122 which effectively modifies the frequency of high frequency sound penetrating the sheath. In addition, the fluid whether gas or liquid, responds to the sinusoidal undulations of the sheath outer surface by transferring the high pressure point of the fluid against the sheath axially from one end of the sheath to the other. Depending upon the mass of the fluid employed, varying degrees of shock absorbency from the movement of the gases through the muffler will be accomplished. Additionally, heat transfer from the interior to the exterior of the sound damper is facilitated by the fluid.

Two effects of the more efficient cooling through the heat transfer fluid are the extension of the life of the resilient sheath and the tendency to lower back pressure due to the cooling of the exhaust gas.

As in the previously described embodiment, the gases exhausting through the slits 118 are ported to the exterior of the tool through the normal gas ports 92 in the outer case of the tool.

It is believed that the damping action of the fluid against the exterior of the resilient sheath causes a "pumping" effect on the gas flow. Because the transfer of pressure on the sheath tends to seal the sheath against the passage port during gas passage from one chamber to another, the gas is caused to dwell within a particular grid for a slightly longer period and heat transfer is thus engendered for a longer period. Such effect lowers the energy level of the gas and thus reduces sound appreciably.

As previously referred to, the density of the heat transfer fluid affects the sound damping of the device. Materials such as the silicone oils have an appreciable sound damping effect as well as efficiently transferring heat. Other fluids, such as the denser gases, water and low-melting point metals, fall within the contemplation of the invention.

In some instances it is desirable to muffle the passage of air and other gases at the intake of a machine. A sound damper 131 for such a purpose is illustrated in partial section in FIG. 7. The sound damper of that Figure comprises an inner canister 132 having an inlet tube 133 from which an attachment flange 134 extends peripherally downstream from the intake arrow indicated at 135. The canister has outer ribs 138, 139. The canister terminates in an end wall 141 which extends in an attachment flange 142 exteriorly of the canister.

A plurality of outlet ports 143 arcuately spaced in the canister periphery between rib 139 and flange 142 conduct gases introduced at inlet 133 into a volume 145 defined by canister wall 146 and an inner wall 147 of a resilient sheath 148.

Wall 147 of the sheath bears against the outer periphery of each of the ribs 138, 139 and subdivides the volume between the canister and the sheath. Gases entering the sheath volume through ports 143 expand the sheath away from the ribs 138, 139 and exhaust from the end of the sheath into a further volume 151 defined about the sheath by an outer canister 152 which terminates downstream in an outlet tube 154. Normally the tube 154 is connected to vacuum or a low pressure mechanism such that the volume 151 tends to be below ambient atmosphere. Thus flow is induced from the inner canister through the resilient sheath and outwardly from the outlet tube 154 to the connected device (not shown).

Figure 7:
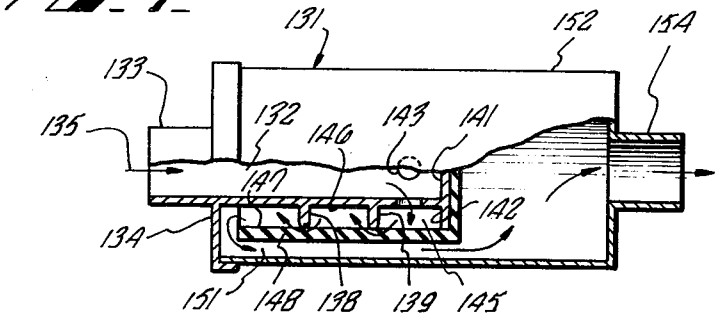
FIG. 7 is an elevational view, partly in section, of a further alternate embodiment of the invention adapted for intake gas muffling.

The device of FIG. 7 has proved to be highly effective in reducing the noise level of air taken into medical breathing apparatus such as resuscitators. The sheath may have as small an outer diameter as 1.75 inches and the total length of the sound damper of FIG. 7 may be as small as 4.5 inches.

By using a secondary outer sheath surrounding the resilient sheath a low pressure volume may be established around the sheath. The sheath therefore fluctuates away from annular ribs 138, 139 more easily and the sheath may be made thicker or stronger for durability without interfering with ease of operation of the muffler cycle.

FIGS. 8–11 illustrate differing embodiments of the invention adapted to add-on use for internal combustion engine mufflers. Each is adapted for accepting an approved spark arrester screen for use in national parks and forests.

The sound damper 161 of FIG. 8 comprises a split entry tube 162 adapted to slip over the end of conventional muffler tail pipes after the muffler. Alternatively, the conventional muffler may be eliminated and the sound damper 161 used directly on the exhaust pipe from an internal combustion engine.

A cylindrical resilient sheath 164 of a material such as silicone rubber defines a volume 165 which is divided by rigid members 166, 167, 168 into smaller volumes. Rigid end member 168 is molded about a flaired end 169 of the tube 162 such that the two elements are essentially intergral. End member 168 has a substantially cylindrical outer surface 171 having a protruding annulus 172 at an edge thereof. An exterior tension clamp 173 binds the resilient sheath to the rigid end member 168 with annulus 172 penetrating the sheath surface to provide a gasproof seal.

A pair of support rods 175 extend through clearance holes 176 in the body of the rigid end member. The rods are threaded and engage rigid intermediate member 166 in bosses 177 in a convex conical wall 178 of the rigid member. Outer rigid member 167 is identical in configuration to member 166, having a conical wall 178, except that holes 179 through the boss section of the condical wall 178 are clearance holes instead of being threaded. Pairs of nuts, such as the nuts 181 space the oppositely oriented conical walls 178 of the rigid members 166, 167 in adjustable manner such that the space in between them may be changed to resonsance tune the sound damper.

Each of the rigid members 166, 167 and 169 has an annular groove 182 adapted to receive a cylindrical screen 184. The screen mesh is such that the muffler meets the qualifications for spark arresting as set down by the various safety regulating agencies. It can be seen that member 167 may be reversed and used in place of member 166 and support the spark arresting screen 184 in the same manner as the element 166.

The sound damper of FIG. 8 is assembled by threading the rods into member 166 and locking member 167 at the proper spacing therefrom by means of the nuts 181. The rods are then surrounded by the screen 184 and the rods inserted into member 168 through the holes 176, and secured thereto by conventional nuts 181A. The embodiment of FIG. 8 is shown in fragmentary section in FIG. 9 such that configuration of the conical walls 178 defining the separation of the chambers is more evident.

Figure 10:
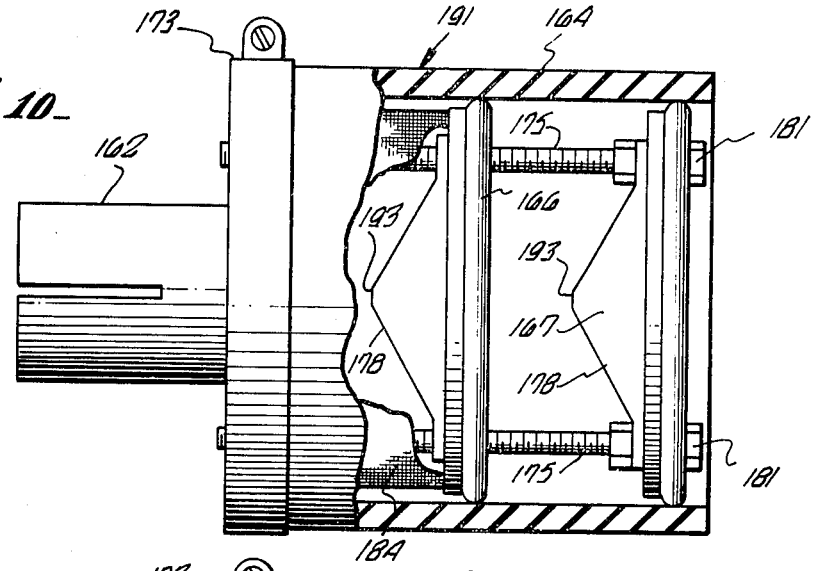
FIG. 10 is a side elevation, partly in section, of a still further embodiment similar to the embodiments of FIGS. 8 and 9.
Figure 9:
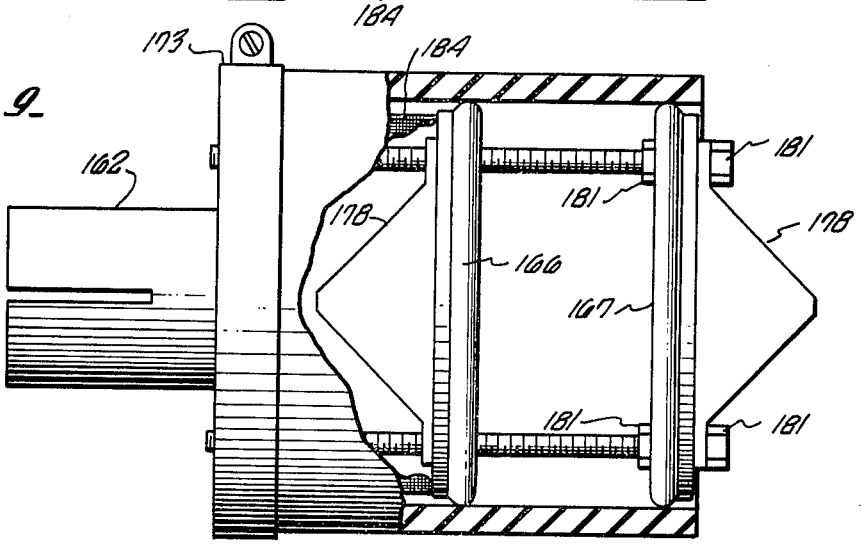
FIG. 9 is a side elevation, partly in section, of an alternate embodiment of the invention similar in function to the embodiment of FIG. 8.

In FIG. 10 a sound damper 191 is shown in elevation, partly broken away. It is similar to the embodiment of FIG. 8 in having an entry tube 162 and a resilient outer sheath 164 with a band 173 securing the sheath to a rigid end member 168 similar to the element of FIG. 8, although not shown in FIG. 10. The volume defined by the sheath interior is subdivided by rigid conical members 166, 167, like those of the previously described embodiment. Rods 175 space the conical members in proper axial orientation. However, in the embodiment of FIG. 10 the orientation of the cones is similar axially in that the apices 193 of each of the cones face in the same upstream direction.

The orientation of the cones has an effect upon the power range of the internal combustion engine associated with the muffler of the invention. At certain levels of pressure output the embodiment of FIG. 10 is desired, although the embodiment of FIG. 8 in tests has proven to give the optimum power output over the widest range of RPMs of engine performance.

Figure 11:
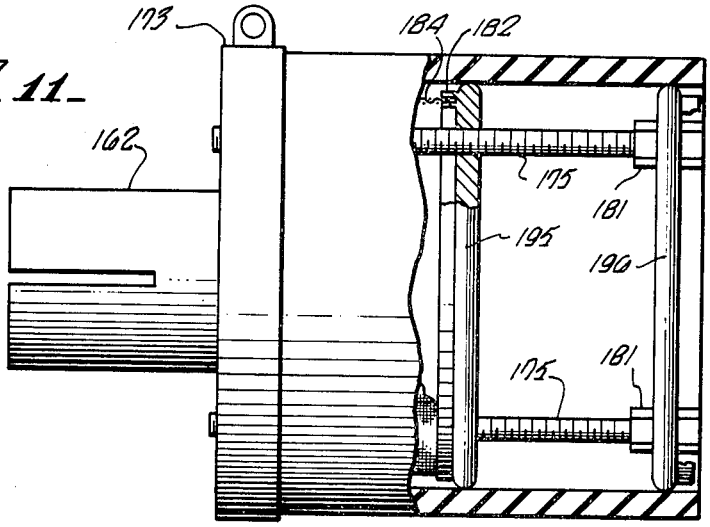
FIG. 11 is a side elevation, partly in section, of a further alternate embodiment of the invention adapted for use with combustion exhaust gases.

A sound damper 194 similar to the embodiments of FIGS. 8 and 10 is shown in FIG. 11 and is similarly comprised. However, the rigid intermediate and outer members 195, 196 have flat walls extending perpendicular to the flow axis and thus are not reversable in axial orientation to adjust like the conical elements 166, 167 of the previously described embodiments to respond to a variety of exhaust gas pressure situations. A spark arrester screen 184 is a part of the combination of the embodiment of FIG. 11 such that sound damper 194 meets all offroad safety requirements.

In FIGS. 12 and 13 sound dampers like those of FIGS. 8 and 10 are modified for use in conjunction with gas or air intakes rather than exhausts. In FIG. 12 a sound damper 201 is shown mounted within a schematically represented carburetor air intake canister 202. The sound damper comprises an outer rigid canister 204 fixed to the floor 205 of the intake canister and is centered above a carburetor intake 206. The outer canister 204 supports an inner resilient sheath 208 which is secured thereto by means of a sheath flange 209 at the intake end of the sheath and a flanged pressure ring 211 clamping the sheath flange to the outer canister.

The volume defined by resilient sheath 208 is subdivided by conical rigid members 212, 213 of substantially similar configuration. A central threaded rod 215 fixed to the air intake shroud 202 is threadably engaged with each of the rigid members 212, 213. The members 212, 213 may be adjusted with respect to each other and with respect to the sheath by rotating them about the threaded member 215. Preferably the upstream member 212 is slightly smaller in diameter to effect a seal of lesser force than the seal effected by member 213 which the sheath surface.

In the operation of the sound damper of FIG. 12 air conventionally entering the intake shroud 202 passes through the ring 211 and is induced to flow about the rounded edges 217 of the rigid members 212, 213 by the intake vacuum of the carburetor. There is a space between exit end 218 of the sheath and the edge 219 of the carburetor intake 206 such that a low pressure condition exists between the outer wall of sheath 208 and the inner wall of canister 204. Thus the sheath is freer to move away from the edges 217 of the rigid members and the flow through the sound damper of FIG. 12 is less impeded than if exposed to pressure of exterior atmosphere. It is believed that the differing forces needed to move the sheath from the rounded edges 217 of the two rigid members imparts a motion pattern in the sheath that further dissipates sound energy.

The embodiment of FIG. 13 is combined with a conventional carburetor air intake shroud 202 by means of a spider 221 through which a threaded member 222 extends to support conical rigid members 224, 225 which are secured to the member 222 by means of nuts 226 in the case of member 224 and by threaded engagement at 227 in the case of member 225. Thus the conical rigid member 224 is adjustable with respect to the member 225 by rotation of the nuts 226 with respect to the threaded rod 222. The sheath 231 of a resilient material, such as silicone rubber, terminates downwardly in a truncated conical end 233 which impinges upon the conical exterior 234 of a flapper valve member 235. The valve 235 may be integrally cast with rigid conical member 225 or be conventionally secured centrally thereto.

The embodiment of FIG. 13 has proved especially valuable in silencing high volume air flow and the movement of the resilient sheath 231 has been aided by a low pressure area 237 within the outer canister 238. The canister terminates downwardly in a reduced intake tube 239 which may be flanged at 240 to provide for a simple mounting to the device ingesting air.

FIG. 14 illustrates an exhaust sound damper 251 in accordance with the invention which is comprised of an inner rigid canister 252 surrounded by a resilient sheath 253. The inner canister has an end plug 255 which is cylindrical in outer configuration and has a reduced diameter central boss 256 from which a spark arrester screen 257 extends to an intake tube 258. The tube contacts an extending collar 259 on the intake tube, the outer periphery of which supports the inner canister 252.

The resilient sheath is spaced from the outer periphery of the canister by a plurality of annular ribs 261, 262, 263. The sheath may be clamped to the canister adjacent rib 261 in any of the previously described manners. However, the ribs 262 and 263 are free to fluctuate away from the inner canister wall as exhaust gases which enter tube 258 pass through the screen 257 and out a plurality of ports 265 in the canister near the termination of the intake tube 258. The pressure of the exhaust gases causes fluctuation of the sheath such that gases pass between the canister and the ribs 262 and 263 to exhaust to atmosphere without danger of sparks and at considerably reduced sound volume.

While several differing embodiments illustrative of the invention have been disclosed herein, they do not exhaust the scope of the invention, many other modifications and changes will be apparent within the scope of the invention to those skilled in this art. It is therefore desired that the invention be measured by the appended claims rather than by illustrative material contained in this specification and drawing.

I claim:

1. A sound damper for use with gas streams, comprising:

a resilient cylindrical sheath first wall of gas impervious material defining a first volume, a rigid second wall defining a second volume, said second wall being surrounded by and concentric with said first wall, said second wall having gas ports therein connecting said first and second volumes, a tube fixed to the second rigid wall and defining a gas entry means connecting to said second volume, contact means including annular ribs integral with a wall and between the first and second walls and dividing the volume between said first and second walls, said contact means being separable from a wall in response to gas pressure to define intermittent gas exit means between said wall and said contact means, a third rigid wall about said resilient wall and defining a third volume, said gas exit means intermittently connecting said second and third volumes, and a gas exit tube on said third wall.

* * * * *